United States Patent [19]

Hosaka

[11] 4,370,962

[45] Feb. 1, 1983

[54] SYSTEM FOR PRODUCING A PULSE SIGNAL FOR CONTROLLING AN INTERNAL COMBUSTION ENGINE

[75] Inventor: Akio Hosaka, Yokohama, Japan

[73] Assignee: Nissan Motor Company, Ltd., Yokohama, Japan

[21] Appl. No.: 246,618

[22] Filed: Mar. 23, 1981

[30] Foreign Application Priority Data

Mar. 24, 1980 [JP] Japan ..... 55-36259

[51] Int. Cl.[3] ..... F02P 5/04; F02D 5/02

[52] U.S. Cl. ..... 123/416; 123/479

[58] Field of Search ..... 123/417, 479, 480, 416

[56] References Cited

U.S. PATENT DOCUMENTS 3,834,361 9/1974 Keely ..... 123/479

4,310,889 1/1982 Imai et al. ..... 123/479 X 4,313,412 2/1982 Hosaka et al. ..... 123/480

FOREIGN PATENT DOCUMENTS 17107 10/1980 European Pat. Off. ..... 123/479

1564073 4/1980 United Kingdom .

1581153 12/1980 United Kingdom .

*Primary Examiner*—Tony M. Argenbright

*Attorney, Agent, or Firm*—Lowe, King, Price & Becker

[57] ABSTRACT

In a system for producing a pulse signal for controlling an internal combustion engine, an engine control pulse signal is calculated by a digital computer during normal operation. If a failure or a malfunction of the digital computer is detected, the engine control pulse signal is replaced with a dummy signal produced by an auxiliary pulse generator.

16 Claims, 5 Drawing Figures

SYSTEM FOR PRODUCING A PULSE SIGNAL FOR CONTROLLING AN INTERNAL COMBUSTION ENGINE

BACKGROUND OF THE INVENTION

1. Field of the Invention

The present invention relates to a system for producing a pulse signal for controlling an internal combustion engine, including a digital control means such as a microcomputer. More specifically, the invention relates to a system which is capable of maintaining the engine operation in case of a failure or a malfunction of an arithemetic unit of the digital control means.

2. Description of the Prior Art

With the recent advancement of microcomputer technology in the field of automobile electronics, digital control means have been developed for controlling the fuel supply amount or the ignition timing of an internal combustion engine.

Digital control means of the above stated type have the advantages of performing accurate and stable control over a long term.

However, once an arithmetic unit of the microcomputer fails to work properly, the unit has a fatal effect on the engine operation; in other words, it becomes completely impossible to maintain the engine operation and a vehicle provided with such an engine is rendered uncontrollable, because it is very likely that the digital arithmetic unit ceases to produce an output signal or it produces an erroneous or random output.

On the other hand, although a system having an analog control means generally suffers from drift it still is capable of maintaining engine operation and thus is advantageous in that the vehicle provided with such a system is still operable in case of a malfunction therein.

However, this type of control means has many defects, such as lack of stability during the long term operation, which requires very fine adjustment for maintaining accurate control, and causes low productivity.

BRIEF SUMMARY OF THE INVENTION

According to the present invention, a system for producing a pulse signal for controlling an internal combustion engine comprises a digital computer for calculating an engine control pulse signal in accordance with engine parameters. The computer includes:

(a) a first output circuit responsive to a reference angular pulse signal produced in synchronism with rotation of the engine crankshaft, and (b) a second output circuit for deriving a marker pulse signal having a regular pulse interval. A circuit for producing a dummy control signal in the event of computer malfunction includes:

(a) a first retriggerable monostable multivibrator for deriving a first switching signal when the pulse interval of the pulse signal produced by the second output circuit exceeds a first predetermined length of time;

(b) a monostable multivibrator responsive to the reference angle pulse signal; and (c) switching means normally connecting the output of the first output circuit to an output of the switching means but connecting the output of the monostable multivibrator to the output of the switching means while the first switching signal is derived.

An object of the present invention is therefore to provide a system for producing an engine control pulse signal which produces an accurate engine control pulse signal by utilizing a digital computer during normal operation, and which is capable of maintaining the engine operation by the use of a dummy engine control pulse signal when a failure or a malfunction of the digital computer is detected.

DETAILED DESCRIPTION OF THE PREFERRED EMBODIMENTS

Figure 1:
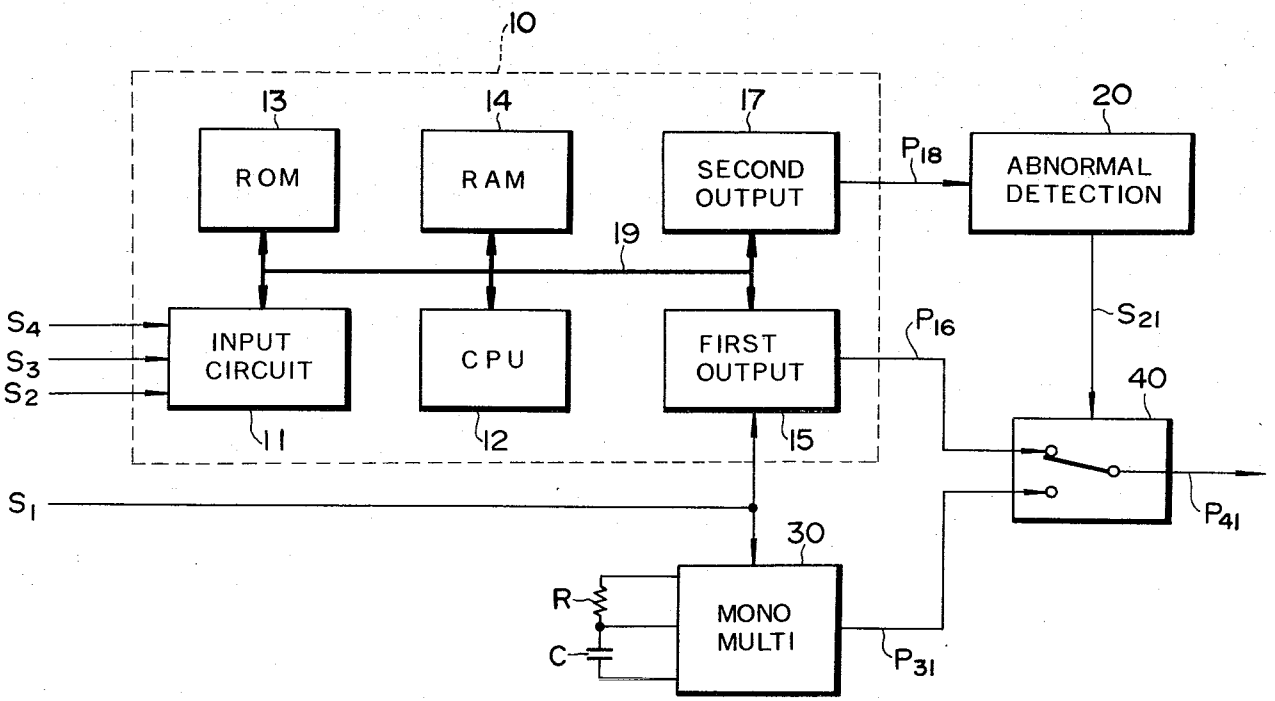
FIG. 1 is a block diagram of a first embodiment according to the present invention.

In FIG. 1, a digital computer 10 includes input circuit 11 for converting various engine parameters into digital form, a central processing unit 12 (referred to as CPU hereinafter), read only memory 13 (referred to as ROM hereinafter), random access memory 14 (referred to as RAM hereinafter), a first output circuit 15 which produces an engine control pulse signal $P_{16}$ having a pulse width determined by data from CPU 12, in synchronism with a reference angular pulse signal $S_1$ generated at specific engine crankshaft rotational positions (for example, each 120 degrees, in case of a 4 cycle, 6 cylinder engine), and a second output circuit 17 for regularly producing a marker pulse signal $P_{18}$ having a predetermined interval in accordance with the data from CPU 12.

The input circuit 11 receives three engine parameters, namely, unit angular pulse signal $S_2$ produced at each 1 degree rotation of the crankshaft of the engine, an inlet air amount signal $S_3$ proportional to the air intake volume (for example, an output signal of an air flow meter), and a temperature signal $S_4$ proportional to the engine temperature.

These parts of the digital computer 10 are interconnected by bus lines 19.

Abnormal detection circuit 20 produces a switching signal $S_{21}$ when it detects a failure of the digital computer 10. The absence of a regular pulse interval of the marker pulse signal $P_{18}$ is utilized for determining a failure or a malfunction of the digital computer 10.

Monostable multivibrator 30 produces a dummy engine control pulse signal $P_{31}$ having a pulse width determined by a resistor R and a capacitor C in synchronism with the reference angle pulse signal $S_1$.

Switching circuit 40 transmits the dummy engine control pulse signal $P_{31}$ while switching signal $S_{21}$ is derived during abnormal operation of computer 10; circuit 40 transmits the engine control pulse signal $P_{16}$ during the normal operation of the digital computer 10.

The operation of the above system is described hereinafter.

In the digital computer 10, CPU 12 reads the data detected by the input circuit 11, i.e., the engine rotational speed signal (derived from the unit angular pulse signal $S_2$), air intake volume signal $S_3$, and engine temperature signal $S_4$ in accordance with a program stored in ROM 13. Computer 10 processes these data to calculate the required amount of fuel to be injected; the calculated fuel injection data are supplied as an input signal to the first output circuit 15.

The data being processed are temporarily stored in RAM 14.

The engine control pulse signal $P_{16}$ is produced at the first output circuit 15 by counting clock pulses having a predetermined frequency determined by data from CPU 12. The pulse width of engine control pulse signal $P_{16}$ is therefore proportional to the above data.

Pulse signal $P_{16}$ is synchronized with the reference angle pulse $S_1$, so one pulse in signal $P_{16}$ is produced for every three of reference angle pulses $S_1$, that is to say, one pulse in signal $P_{16}$ is produced for every revolution of the crankshaft, in the above example.

The output circuit 17 produces the marker pulse signal $P_{18}$ having a regular pulse interval. In order to produce this marker pulse signal $P_{18}$, it is preferable to insert a routine into the program of computer 10; output circuit 17 responds to the program to produce a marker pulse signal $P_{18}$ after every calculation cycle has been completed.

As long as CPU 12 and ROM 13 operate properly, the marker pulse signal $P_{18}$ is regularly produced. However, if the program execution is disturbed, the marker pulse signal $P_{18}$ is no longer produced.

Therefore, comparing the period of the marker pulse signal $P_{18}$ with a predetermined reference length of time determines whether or not digital computer 10 works properly.

A retriggerable monostable multivibrator is used in abnormal detection circuit 20 for producing the switching signal $S_{21}$. The duration of the quasi-stable stage of the retriggerable monostable multivibrator is set to be slightly longer than the interval of the marker pulse signal $P_{18}$ during normal operation. Therefore, the retriggerable monostable multivibrator is repeatedly triggered by the marker pulse signal $P_{18}$ while computer 10 is operating normally. Thus, the switching signal $S_{21}$ respectively has "0" and "1" values for indicating abnormal and normal conditions of the digital computer 10.

The monostable multivibrator 30 derives the dummy engine control pulse signal $P_{31}$ when the digital computer 10 fails to operate properly. Monostable multivibrator 30 is preferably an integrated circuit for producing a pulse signal each time reference angle pulse signal $S_1$ is supplied to it. The pulse width of the output signal of multivibrator 30 is proportional to the product of the externally connected resistor R and capacitor C.

The switching circuit 40 is made up of a relay or analog switch for selectively transmitting one of the pulse signals $P_{16}$ or $P_{31}$ in accordance with the switching signal $S_{21}$. As long as the digital computer 10 operates properly, that is, the switching signal $S_{21}$ has "0" value, the switching circuit 40 selects the engine control pulse signal $P_{16}$ produced by the digital computer 10, and outputs it as the pulse signal $P_{41}$ for controlling the fuel injection valve. Conversely, when the digital computer 10 does not operate properly, this switching circuit 40 selects the dummy engine control pulse signal $P_{31}$ of the monostable multivibrator 30 and outputs it as the pulse signal $P_{41}$.

It is to be noted that the pulse width of the pulse signal $P_{16}$ is variably and optimally calculated according to the engine operation, while the pulse signal $P_{31}$ has a fixed pulse width. So, the pulse signal $P_{31}$ is not perfectly suited for the whole range of the engine operation. However, it is sufficient to maintain the engine operation under a restricted condition such that the vehicle is able to run along a level road at a constant speed below 50 km/h, since the normal enine control pulse under a condition described above has the same pulse width. Thus, the vehicle can be operated in response to pulse signal $P_{31}$ until it arrives at a garage where servicing is available.

In addition, since the pulse signal $P_{31}$ is produced in synchronism with the reference angular pulse signal $S_1$, which occurs every 120 degrees revolution of the crankshaft (every one third crankshaft revolution) while the pulse signal $P_{16}$ is produced every one revolution of the crankshaft, the pulse width of the pulse signal $P_{31}$ is set to be one third that of the pulse signal $P_{16}$.

It is well known that the fuel injection valves generally have delay response characteristics, which lower precision of fuel injection. The precision of the fuel injection is reduced especially when the pulse width of a driving pulse signal has a very short duration time.

Therefore, there is one injection effected once during every revolution of the crankshaft which lengthens the injection time duration, thereby improving the precision of fuel supply amount; viz, the precision of the fuel injection amount is improved as the frequency of fuel injection decreases, because the fuel supply amount for each injection increases with decreases of the fuel injection frequency.

Thus in the present system, it is preferable to reduce the frequency of pulse signal $P_{31}$ in order to assure the precise operation of the fuel injection valve. Therefore, to reduce the frequency of the pulse signal $P_{31}$, a frequency dividing circuit which provides an output pulse for every three input pulses may be provided between the reference angular pulse generator and the monostable multivibrator 30.

Of course, this dividing circuit is omissible to reduce the number of component parts.

Figure 2:
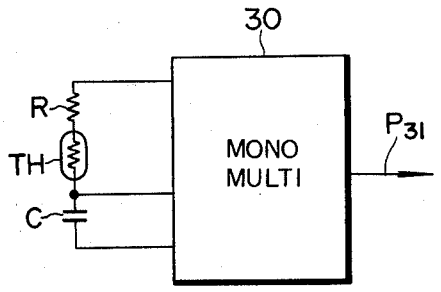
FIGS. 2 and 3 are other examples of the monostable multivibrator shown in FIG. 1.

Also it is well known that a rich air-fuel mixture, that is, additional fuel, is required when the engine temperature is low. In order to vary the pulse width of pulse signal $P_{31}$ with the engine temperature, a thermister TH is preferably coupled in series with the resistor R of the monostable multivibrator 30 as shown in FIG. 2. By means of this thermister TH, the combined resistance of the pulse width determining circuit of monostable 30 varies with the engine temperature. Specifically, the pulse width determining circuit has a large electric resistance when the engine temperature is low, and has a small electric resistance when the engine temperature is high. Therefore, the pulse width of the pulse signal $P_{31}$ varies with the engine temperature as the variation of product of said combined resistence and the capacitor C, which have a large value when the engine temperature is high. An approximation of the temperature responsive engine fuel supply control is thus performed.

Figure 3:
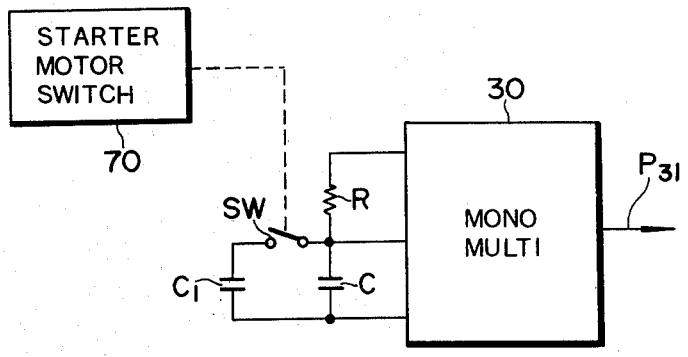

In addition, an increase in fuel is also required during engine starting operation. Such an increase in fuel is enabled by providing the pulse width determining circuit of monostable 30 with an additional capacitor $C_1$ in shunt with capacitor C and a switching means, such as a relay switch SW responsive to the operation of the starter motor switch as shown in FIG. 3. As the closure of relay switch SW, the capacitor $C_1$ is coupled in parallel to the capacitor C of the monostable multivibrator. Thus, the combined capacitance increases when the starter motor is operated. As a consequence, the pulse width of the pulse signal $P_{31}$ is widened. Thus, an increase in the amount of fuel supply is performed to ensure an easier engine starting operation.

Figure 4:
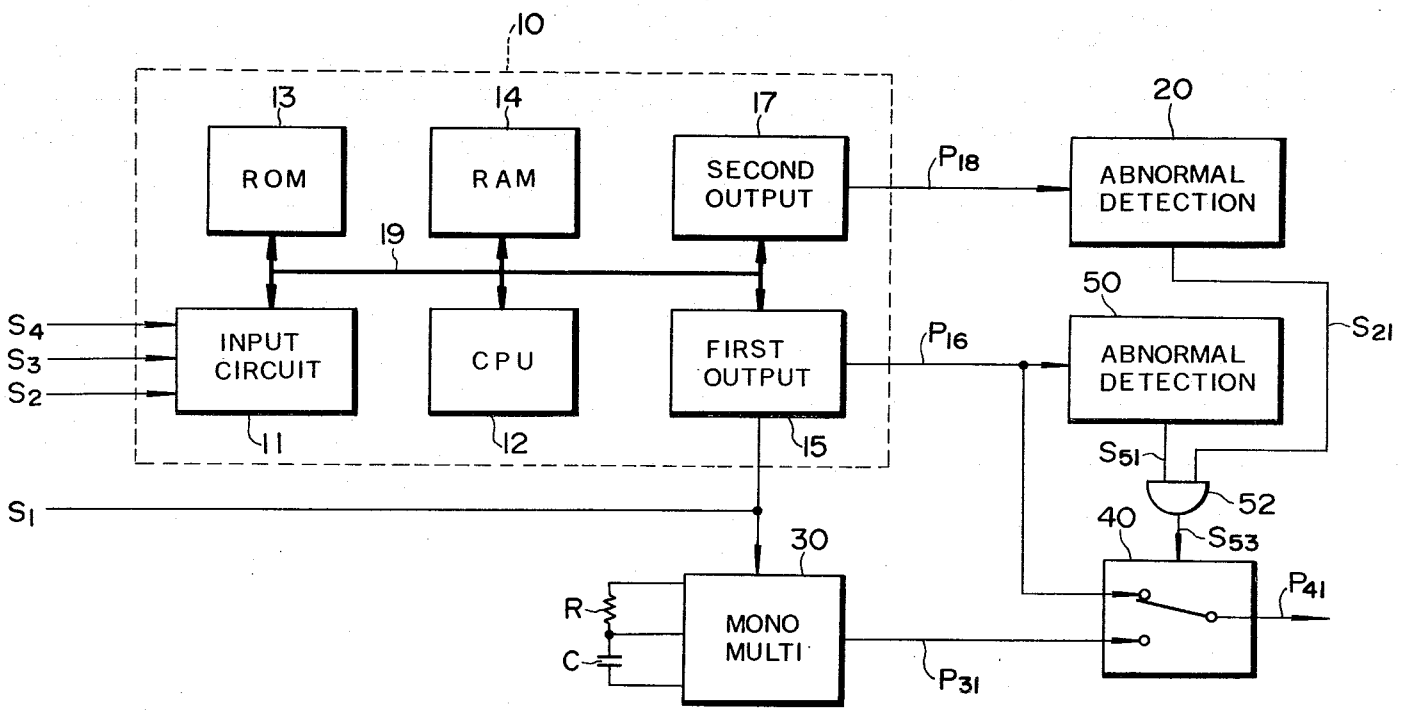
FIG. 4 is a block diagram of a second embodiment according to the present invention.

FIG. 4 is a block diagram of a second embodiment according to the present invention.

In FIG. 4, abnormal detection circuit 50 detects the abnormal condition of the first output circuit 15 by responding to the repetition rate of the engine control pulse signal $P_{16}$. The same elements as those in FIG. 1 or equivalents thereto are indicated by the same numerals.

A feature of the FIG. 4 embodiment is detection of a failure of the first output circuit 15.

As in the abnormal detection circuit 20 of FIG. 1, the abnormal detection circuit 50 comprises a retriggerable monostable multivibrator which produces a switching signal having "1" value when the pulse interval of the pulse signal $P_{16}$ is shorter than a predetermined length of time, (normal operation), and having "0" value when the pulse interval of the pulse signal $P_{16}$ is longer than the predetermined length of time (abnormal condition).

In addition, there is an inverse proportional relation between the interval or length of the pulses in signal $P_{16}$ and the engine rotational speed. Accordingly, it is preferable to set the reference level of detector 50 so it corresponds to a lowest limit of the engine rotation (for example 200 rpm). If the first output circuit 15 fails, it ceases to produce the engine control pulse signal $P_{16}$, then a switching signal $S_{51}$ having a "0" value, is produced.

This switching signal $S_{51}$ together with the switching signal $S_{21}$ of the abnormal detection circuit 20 are supplied to an AND gate 52, the output signal $S_{53}$ thereof is used for driving the switching circuit 40.

If all parts of the digital computer 10 operate properly, pulse signals $P_{16}$ and $P_{18}$ are regularly produced. Then the switching signals $S_{21}$ and $S_{51}$ both have a value of "1", causing switching signal $S_{53}$ to be derived from the AND gate 52. Switching signal $S_{53}$ activates switching circuit 40, so circuit 40 selects the engine control pulse signal $P_{16}$ and supplies it as a control for the engine.

If at least one of pulse signals $P_{16}$ or $P_{18}$ is not produced, at least one of switching signals $S_{21}$ and $S_{51}$ has "0" value, whereby switching circuit 40 selects the pulse signal $P_{31}$ since the switching signal $S_{53}$ has the value "0".

By the above construction, an abnormality at any parts of the digital computer 10, including the first output circuit 15, is detected and the dummy engine control pulse signal $P_{31}$ is selected for maintaining the engine operation.

Up to the above description, the invention is explained by way of an example of fuel injection control system, however, the invention is also adaptable to a system for producing an ignition timing control signal.

In such a case, the system has the same construction as shown in FIGS. 1 and 4.

In an ordinary electronically controlled ignition system, a primary current of an ignition coil is cut off during the rising edge of a control signal, while, the ignition occurs.

In the present system, if the digital computer 10 fails, the dummy engine control signal $P_{31}$ is used for determining a fixed ignition timing, such as about 10 degrees before the top dead center point. Since the dummy engine control pulse signal $P_{31}$ is produced in synchronism with the reference angular pulse signal $S_1$, the angular position of the crankshaft where the base angular pulse signal $S_1$ is produced is about 10 degrees before the top dead center point. Thus, the primary current of an ignition coil is cut off during the rising edge of the pulse signal $P_{31}$, and the supply of the primary current is restarted during the trailing edge of the pulse signal $P_{31}$.

By the above operation, the function of the ignition system is maintained when the digital computer 10 fails (in this case, the timing shut off of primary ignition current for determining the ignition timing and the timing for determining the primary current duration are controlled by the digital computer 10).

Furthermore, the present invention is readily adapted to a system for providing a pulse signal other than the fuel injection control signal or the ignition control signal.

If such a pulse signal is not synchronized with the engine rotation but is of a type having a duty factor which varies with a predetermined period, it is preferable to utilize an astable multivibrator in place of the monostable multivibrator 30.

In the third embodiment of FIG. 5, wherein digital computer 10 does not work properly when the power supply (generally, a battery) thereof drops below the usual supply voltage of 5 V, the output signal of the monostable multivibrator 30 is utilized in place of the output of the digital computer. This is due to the fact that an analog circuit such as a monostable multivibrator, can generally operate at a low supply voltage of 2 to 3 V.

Figure 5:
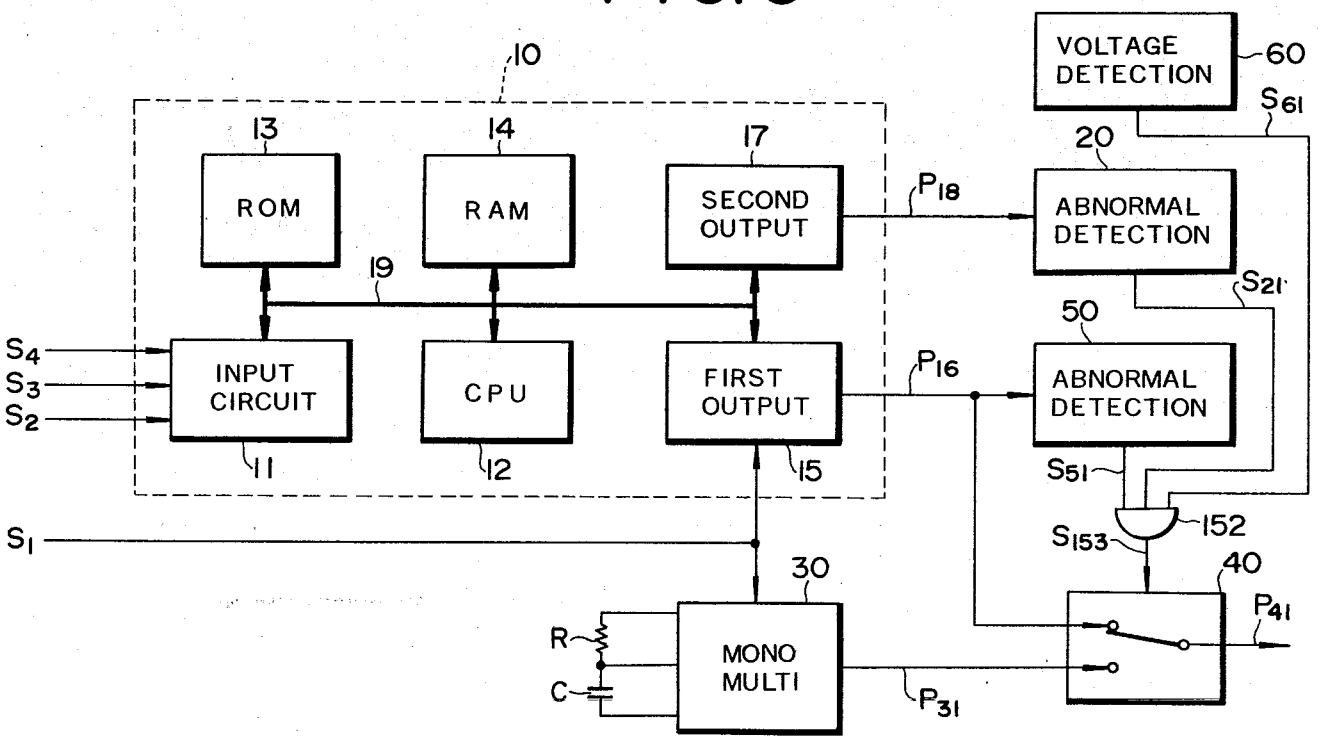
FIG. 5 is a block diagram of a third embodiment according to the present invention.

In FIG. 5, supply voltage detection circuit 60 produces an output signal $S_{61}$ responsive to the reduction of the power voltage for the digital computer 10. The same elements as those in FIGS. 1 and 4 or equivalents thereto are indicated by the same numerals.

The voltage detector circuit 60 includes a comparator which compares the power voltage, such as a storage battery voltage, with a predetermined reference voltage. The output signal $S_{61}$ is supplied to AND gate 152 which also receives the output signals $S_{21}$ and $S_{51}$ of the abnormal detection circuits 20 and 50. The and gate 152 produces a switching signal for driving the switching circuit 40 to select the pulse signal $P_{16}$ if all of the input signals $S_{21}$, $S_{51}$, and $S_{61}$ have "1" value. Conversely, if at least one of these signals $S_{21}$, $S_{51}$ and $S_{61}$ has "0" value, the switching circuit 40 selects the dummy engine control pulse signal $P_{31}$. Thus, in addition to detecting a failure of the digital computer 10, a reduction of the power supply voltage is detected by the present system.

Finally, when the function of the digital computer 10 is influenced by an external noise source to cause a malfunction of the digital computer 10, such a malfunction is detected by the present system, in which case the engine control pulse signal $P_{16}$ is replaced by the dummy signal $P_{31}$. However, if the program can not be executed by the digital computer 10 because of external noise, the control can not return to the normal state when the noise disappears. Therefore, the digital computer 10 must be reset to restart the program execution. Accordingly, it is preferable to use the switching signal $S_{21}$, $S_{51}$ or $S_{153}$ not only for driving the switching circuit 40 but also for resetting the digital computer 10. In addition, when the digital computer 10 returns to the normal program execution, the switching circuit 40 selects the pulse signal $P_{16}$ and the system automatically returns to the normal engine control operation.

It will be readily appreciated that the present system provides a precise and stable engine control pulse signal calculated by a digital computer during normal operation of the digital computer, and it provides a dummy engine control pulse signal when a failure or a malfunction of the digital computer occurs, thereby maintaining the engine operation.

What is claimed is:

1. A system for normally producing a first pulse signal for controlling an automotive internal combustion engine in response to engine operating parameters, such as engine crankshaft reference angle position pulses, air intake volume and engine temperature, and for producing a second pulse signal for controlling the engine in the event of a failure of circuitry responsive to the parameters, comprising:

(A) a digital computer responsive to the parameters for controlling the derivation of engine control pulses in accordance with the parameters, said computer including:

(a) a first output circuit responsive to the reference angle pulses for deriving engine control pulses, and (b) a second output circuit for deriving a marker pulse signal having a regular pulse interval; and (B) a circuit for producing a dummy control signal in response to a computer malfunction, including:

(a) a first retriggerable monostable multivibrator responsive to the marker pulse signal derived by said second output circuit, said first retriggerable monostable multivibrator deriving a first switching signal in response to the pulse interval of the pulse signal produced by the second output circuit exceeding a first predetermined length of time;

(b) a monostable multivibrator responsive to the reference angle pulse signal for deriving further control pulses synchronized with the reference angle position pulses; and (c) switching means having an output terminal and an input connected to be controlled by said first retriggerable monostable multivibrator for normally coupling the control pulses derived by said first output circuit to the output terminal and for coupling the further pulses derived by said monostable multivibrator to the output terminal while said first switching signal is derived.

2. The system of claim 1 further comprising:

a second retriggerable monostable multivibrator connected to derive a second switching signal in response to the pulse interval at the output of said first output circuit exceeding a second predetermined length of time; and an AND gate circuit responsive to said first and second retriggerable monostable multivibrators for controlling the switching means so the control pulses are coupled to the output terminal only in response to a pulse interval at an output of said first output circuit exceeding a second predetermined length of time and while the computer is deriving the engine control pulses.

3. The system of claim 2 further comprising:

a voltage detecting circuit for detecting the voltage supplied to said computer, said AND gate circuit being responsive to the voltage detecting circuit for controlling the switching means so the control pulses are coupled to the output terminal only in response to the detected voltage falling below a predetermined level.

4. The system of claim 1 wherein said monostable multivibrator includes impedance means, the impedance means including a resistor and a capacitor connected to control the duration of pulses derived thereby.

5. The system of claim 4 wherein said resistor is variable in response to the temperature of said engine so that the duration of the pulses is dependent upon the engine temperature.

6. The system of claim 4 wherein the impedance means is variable, and means for changing the value of the variable impedance means in response to the engine being started so the duration of the pulses derived by the monostable multivibrator increases as the engine is being started relative to the duration during normal running of the engine.

7. The system of claim 1, wherein said computer is connected to be reset in response to said switching means connecting said output terminal to be responsive to pulses derived from said monostable multivibrator.

8. In an apparatus for controlling timing of fuel injection valves or ignition of an automotive internal combustion engine in response to engine performance parameters, such as air intake volume engine temperature and crankshaft rotation angle, the apparatus comprising a digital computer responsive to the parameters for deriving a first pulsed engine control signal with pulses having widths dependent upon the values of the parameters and an occurrence time in synchronism with the crankshaft passing predetermined reference angles, a triggered monostable pulse generator responsive to crankshaft rotation for deriving a second pulsed engine control signal with pulses having an occurrence time in synchronism with the crankshaft passing the predetermined reference angles, means for sensing abnormal operation of the computer, and switch means responsive to the sensing means for coupling the first signal to a means for controlling the timing to the exclusion of the second signal while the computer operates normally and for coupling the second signal to the means for controlling the timing to the exclusion of the first signal while the computer operates abnormally.

9. The apparatus of claim 8 further including a sensor for the engine temperature and means responsive to the sensor for controlling the width of pulses of the second signal so the pulses of the second signal change width as the engine temperature changes.

10. The apparatus of claim 8 further including a sensor for the engine being commanded to start and means responsive to the sensor for controlling the width of pulses of the second signal so the pulses of the second signal change width as the engine is commanded to start.

11. The apparatus of claim 8 wherein the computer means includes means for deriving a marker pulse signal having an occurrence rate determined by the parameters, and the means for sensing the abnormal operation includes means responsive to the marker pulse signal for deriving an indicator signal having a value indicative of abnormal operation in response to the marker pulse signal having a frequency less than a predetermined value, the indicator signal controlling the switch means.

12. The apparatus of claim 8 or 11 wherein the means for sensing the abnormal operation includes means responsive to the frequency of the first engine control signal dropping below a predetermined value for deriving an indicator signal having a value indicative of abnormal value, the indicator signal controlling the switch means.

13. The apparatus of claim 12 wherein the means for sensing the abnormal operation includes means responsive to the voltage of a power supply for the computer dropping below a predetermined value for deriving an indicator signal having a value indicative of abnormal value, the indicator signal controlling the switch means.

14. The apparatus of claim 8 or 11 wherein the means for sensing the abnormal operation includes means responsive to the voltage of a power supply for the computer dropping below a predetermined value for deriving an indicator signal having a value indicative of abnormal value, the indicator signal controlling the switch means.

15. The apparatus of claim 8 wherein the computer means includes means for deriving a marker pulse signal having an occurrence rate determined by the parameters, and the means for sensing the abnormal operation includes means responsive to the marker pulse signal for deriving an indicator signal having a value indicative of abnormal operation in response to the marker pulse signal having a frequency less than a predetermined value and responsive to the frequency of the first engine control signal dropping below a predetermined value, the indicator signal controlling the switch means.

16. The apparatus of claim 8 wherein the computer means includes means for deriving a marker pulse signal having an occurrence rate determined by the parameters, and the means for sensing the abnormal operation includes means responsive to the marker pulse signal for deriving an indicator signal having a value indicative of abnormal operation in response to the marker pulse signal having a frequency less than a predetermined value, and responsive to the frequency of the first engine control signal dropping below a predetermined value and responsive to the voltage of a power supply for the computer dropping below a predetermined value, the indicator signal controlling the switch means.

* * * * *